United States Patent [19]

Horst et al.

[11] 4,233,712

[45] Nov. 18, 1980

[54] STIRRUP BUCKLE

[75] Inventors: Thomas A. Horst, 2801 N. 111th St., Lafayette, Colo. 80026; Charles L. Welton, Golden, Colo.

[73] Assignee: Thomas A. Horst, Lafayette, Colo. by said Charles L. Welton; past interest

[21] Appl. No.: 198

[22] Filed: Jan. 2, 1979

[51] Int. Cl.[3] ..... A44B 11/02

[52] U.S. Cl. ..... 24/166; 24/180; 54/46

[58] Field of Search ..... 24/164, 166, 167, 168, 24/171, 181, 180, 177; 54/46

[56] References Cited

U.S. PATENT DOCUMENTS

| | | | |
|---|---|---|---|
| 133,904 | 12/1872 | Walker | 24/164 |
| 3,096,552 | 7/1963 | Kreger, Jr. | 24/166 |
| 3,175,266 | 3/1965 | McMullen | 24/181 |
| 3,205,637 | 9/1965 | Welton | 24/180 X |
| 3,314,121 | 4/1967 | Blevins et al. | 24/181 |
| 4,141,198 | 2/1979 | Gaertner | 24/164 X |

FOREIGN PATENT DOCUMENTS

| | | | |
|---|---|---|---|
| 1320213 | 1/1963 | France | 24/166 |

*Primary Examiner*—Kenneth Downey

*Attorney, Agent, or Firm*—Edwin L. Spangler, Jr.

[57] ABSTRACT

This invention relates to an improved stirrup buckle characterized by a generally channel-shaped "keeper" having at least one and preferably a pair of pins projecting therefrom in side-by-side spaced relation adapted to enter selected registered pairs of apertures in the overlapped layers of the looped leather stirrup supporting strap, and a sleeve-like "slide" permanently affixed to the keeper with a pin and slot connection for limited slidable movement relative thereto between a telescoped position covering the pins and holding the strap layers thereon to an open position uncovering the pins so that one or more layers of strap can be removed therefrom and relocated to raise or lower the stirrup relative to the saddle from which it hangs. The buckle also includes pin-receiving pockets formed between mating surfaces of the keeper and slide that permanently retain the enlarged head of the pins therein while preferably permitting the shank thereof to tilt and even move up or down and laterally to accommodate mispositioned pin-receiving apertures. The buckle also includes interengagable means effective to releasably maintain the elements thereof in closed or telescoped position.

5 Claims, 7 Drawing Figures

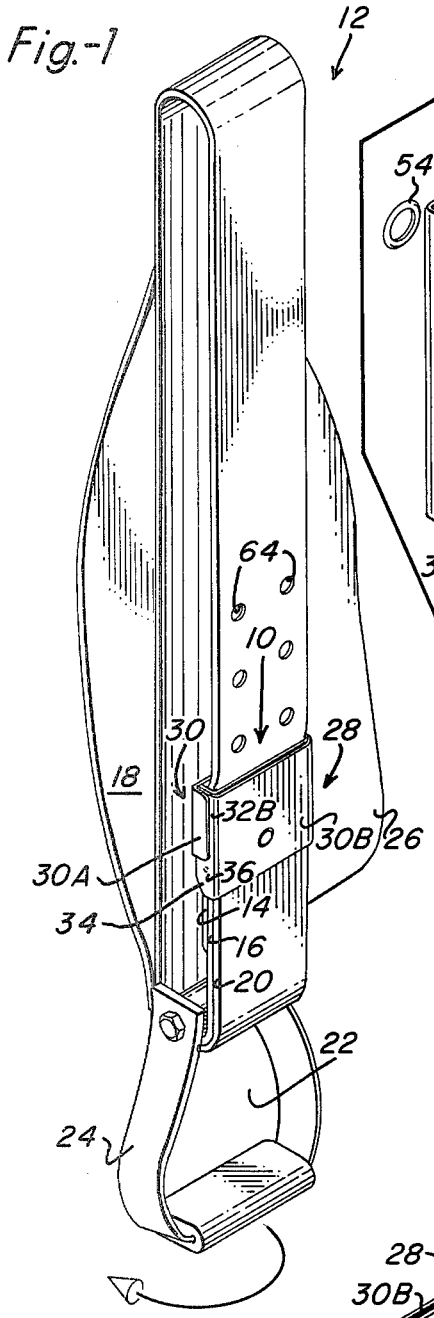
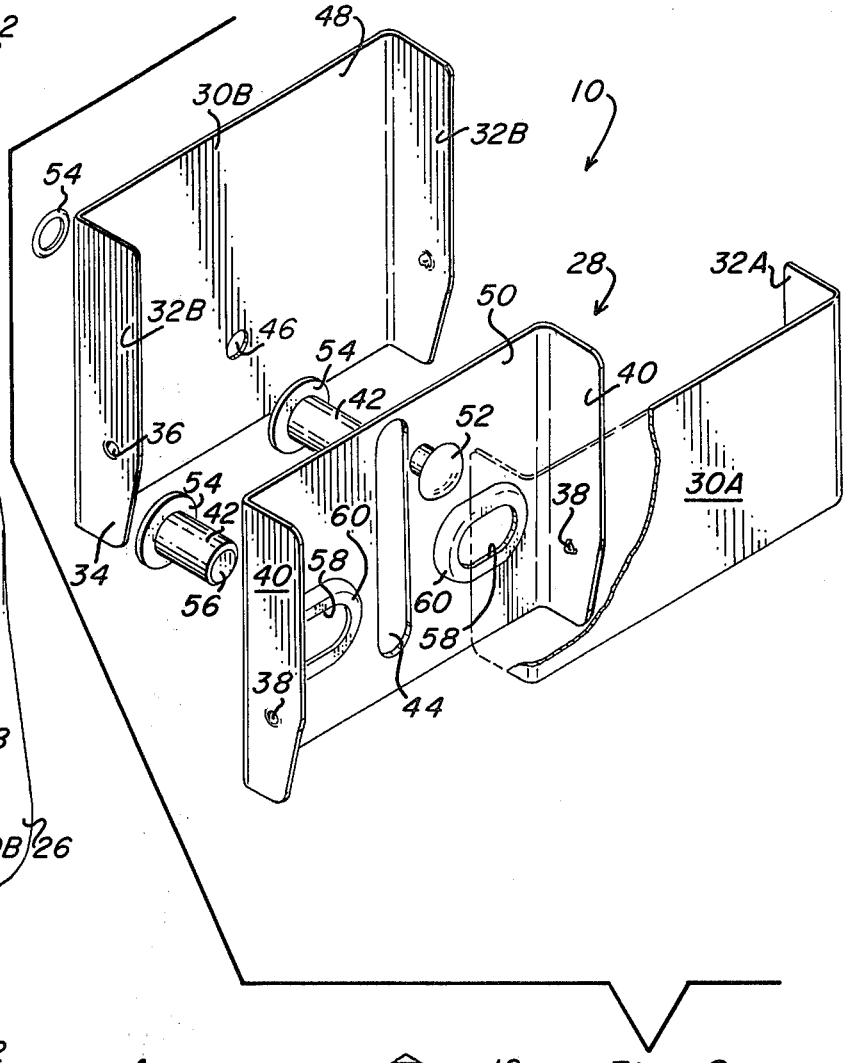
Fig.-2
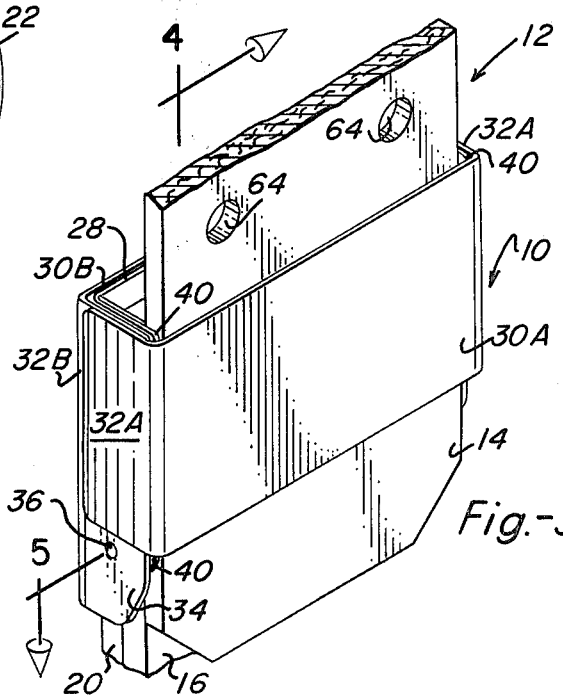
Fig.-3

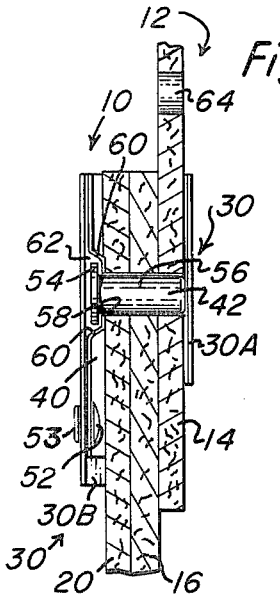
Fig.-4
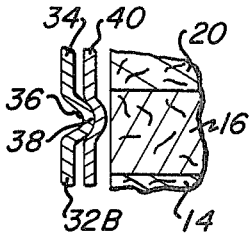
Fig.-5
Fig.-6
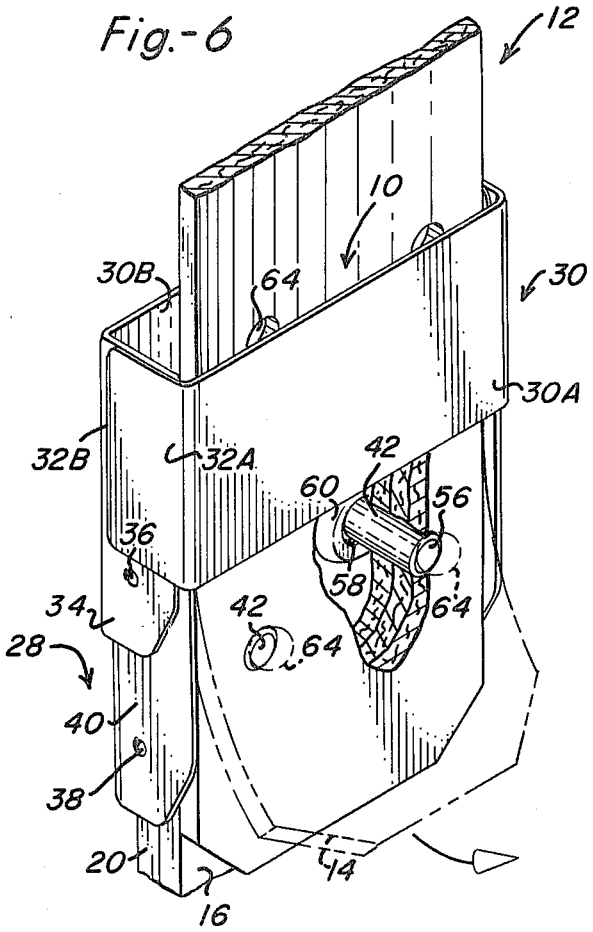
Fig.-7
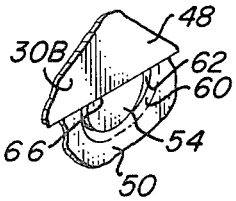

STIRRUP BUCKLE

So-called "stirrup leathers" are the looped leather straps hanging from opposite sides of a saddle that loop through the eye of a stirrup and support the latter in suspended position therebeneath. Since the riders vary considerably in size, means must be provided for adjusting the height of the stirrup to accommodate individual needs. These stirrup leathers which for the sake of clarity will be referred to merely as "straps" as the description proceeds, almost always, on a Western Saddle at least, carry a series of pin-receiving apertures, each pair of which is arranged in side-by-side spaced relation. The size and spacing is essentially standard although some variation does exist. Also, these holes stretch and become otherwise distorted following prolonged use.

Stirrup buckles are notoriously old in the art. Of those known to applicant, the following ones covered by U.S. patents are worthy of specific mention:

Kreger Buckle: U.S. Pat. No. 3,096,552

Welton Buckle: U.S. Pat. No. 3,205,637

Blevins et al Buckle: U.S. Pat. No. 3,314,121

The Kreger two-part buckle uses a pair of vertically-aligned pins on the keeper part of the unit which pass through selected pairs of vertically-aligned slots in an overlapped layer of the strap. The free ends of the pins have enlarged heads which project onto the face of the apertured layer of the strap in position to receive a key-slotted slide. The key slot in the slide locks onto one pin of the pair while a second opening therein slips over the other pin and releasably locks the slide in place. The problems with the Kreger Buckle are, basically, the chance of losing the slide, the special way in which the keeper must be attached, and the somewhat uncommon aperture arrangement.

Welton uses a hinged closure which works quite satisfactorily but on an entirely different principle than that of the instant invention. Its pertinency lies in the fact that the inventor, who incidentally is a co-inventor, of the buckle forming the subject matter hereof, shows in this his earlier patent the idea of mounting headed pins within elongated slots to accommodate any lack of uniformity in the placement of the pin-receiving openings in the strap.

By far the most pertinent of the prior art patented stirrup buckles is that of Blevins et al which, in the manner of the instant invention, uses a keeper element having a pin-carrying tongue that is telescopically received inside a tubular slide. The slide in closed telescoped position keeps the apertured layer of the strap on the pins in a manner not too different from that of the instant slide. In open position, on the other hand, Blevins' slide becomes completely detached from his keeper and, should the loop open, the slide is free to fall off and become lost. As was the case with the Kreger Buckle, the keeper-carrying layers of the strap must be specially prepared to receive the keeper and it thus becomes a unit which is best mounted by a saddlemaker or the like.

The instant stirrup buckle is considered superior to either the Kreger or Blevins Buckle because, as was the case with the Welton Buckle, the two main elements thereof namely, the keeper and slide remain permanently interconnected. Secondly, again in common with the Welton Buckle, no particular skill is required to mount same since no part of the strap is permanently attached to either part of the buckle. Instead, the pins passing through one of the overlapped strap layers suffice to mount the entire assembly.

It is, therefore, the principal object of the present invention to provide a novel and improved stirrup buckle.

A second objective is the provision of a device of the type aforementioned that will fit essentially all the standard Western Saddles having stirrup leathers with horizontally-aligned pairs of pin-receiving apertures.

Another object is to provide a two-part stirrup leather buckle wherein the two main parts thereof, namely, the keeper and slide remain permanently interconnected as a unitary subassembly.

Still another objective of the within described invention is to provide a piece of saddle hardware which will not injure or otherwise harm either the horse or rider in normal use.

An additional object is to provide a telescoping stirrup strap buckle which locks in closed telescoped position and is secure against accidental release yet requires no permanent attachment.

Further objects of the instant invention are to provide a stirrup buckle which is compact, lightweight, easy to install and operate, versatile, effective for its intended purpose and even decorative.

Other objects will be in part apparent and in part pointed out specifically hereinafter in connection with the description of the drawings that follows, and in which:

FIG. 1 is a perspective view showing the stirrup buckle closed in place to detachably fasten the overlapped ends of a looped stirrup-carrying strap together, the particular strap shown including a so-called "fender" and its associated tongue-like length of strap passing through the eye of the stirrup and into the buckle;

FIG. 2 is an exploded perspective view of the buckle alone to a greatly enlarged scale, portions of the slide having been broken away to more clearly reveal the keeper;

FIG. 3 is a fragmentary perspective view analogous to FIG. 2 and to the same scale showing the buckle in closed position on the strap;

FIG. 4 is a fragmentary section taken along line 4—4 of FIG. 3;

FIG. 5 is a fragmentary section to an even further enlarged scale taken along line 5—5 of FIG. 3;

FIG. 6 is a fragmentary perspective view much like FIG. 3 and to the same scale but differing therefrom in that the assembly is shown in closed position; and, FIG. 7 is a fragmentary detail showing how the slide functions even in open position to partially cover the heads of the pins and retain them in the pockets therefor in the keeper.

Referring next to the drawings for a detailed description of the present invention, reference numeral 10 has been chosen to broadly identify the stirrup buckle of the present invention and numeral 12 to similarly denote the looped leather strap which adjustably connects the overlapped ends 14 and 16 thereof together in face-to-face relation. Strap 12, in the particular form shown, includes a leather "fender" 18 which has an integrally-formed tongue 20 depending from the lower end thereof that is looped through the eye 22 of the stirrup 24 and attached to the buckle 10 in a manner which will be set forth in detail presently. The net result is that the strap 12 has two plys or layers of leather belting passing through the stirrup and three such plys or layers held together by the buckle. For purposes of orientation, the assembly shown in FIG. 1 will be on the right side of a saddle with the flap 26 on the fender to the rear. Thus, the buckle 10 lies next to the horse's body while the fender is interposed between the latter and the rider's leg. As seen in FIG. 1, the front of the saddle will lie to the left and the stirrup will rotate about a quarter of a turn in the direction of the arrow to receive the rider's right foot.

Buckle 10 consists of two main parts, the first of which has been designated herein as a "keeper" and broadly identified by reference numeral 28. The other of the two main elements is called a "slide" and it has been referred to in a general way by reference numeral 30. Slide 30, as shown in the exploded view of FIG. 2, is actually made up of two channel-shaped parts 30A and 30B which have their inturned parallel side flanges 32A and 32B, respectively, placed in face-to-face telescoped relation and welded together to define a tubular sleeve. This is, of course, but one of many different ways slide 30 can be fabricated including that of making it out of a single length of strap metal bent into the form of a closed loop. Element 30B of the slide is longer than element 30A so as to leave a skirt 34 hanging beneath the latter. As shown, flanges 32A are spread slightly farther apart than flanges 32B so as to receive the latter therebetween.

Flanges 32B of slide element 30B also include indented detents 36 in the skirt 34 which are releasably received in similar detents 38 in the flanges 40 of the keeper as is most clearly shown in FIG. 5. The slide 30 is raised up as shown in FIG. 6 to uncover the pins 42 carried by the keeper and, for this reason, is held closed by its own weight; nevertheless, some interengageable means like detents 36 and 38 are preferred to releasably latch the assembly in the closed position of FIGS. 3, 4 and 5. While other well-known types of releasable latches may, of course, be substituted for the interlocking detents shown without the exercise of invention, the particular form of latch illustrated has the advantage of being exceedingly simple and easy to make.

Next, with reference to FIG. 2, it can be seen that the keeper has a vertically-extending slot 44 spaced midway between its inturned flanges 40. These flanges 40 are spaced apart slightly less than flanges 32B of slide element 30B so as to fit therebetween and permit the keeper to assume a nested relationship therein. When so nested, an aperture 46 in the web 48 of slide element 30B lines up with slot 44 in the web 50 of the keeper and pin 52 locks the two together for limited relative slidable movement the length of the slot. Fastener 53 attaches to the pin and completes the connection.

Looking next at FIGS. 2, 4 and 6, pins 42 will be seen to include an enlarged head 54 encircling the shank 56 thereof at one end. Spaced equidistant on opposite sides of slot 44 in web 50 of the keeper are a pair of pin-receiving openings 58, both of which are bordered by a recessed portion 60. Upon placement of web 50 of the keeper in face-to-face contacting relation with web 48 of slide element 30B, the latter surface cooperates with these recesses to define pockets 62 adapted to receive and retain the heads 54 of the pins when the shanks 56 thereof project through the pin-receiving openings therein. In the preferred embodiment of the invention, the depth of the recesses is slightly greater than the thickness of the pin heads which fact, coupled with the transverse elongation of openings 58 permits the pins to both tilt and move from side-to-side in order to accommodate misaligned strap openings 64. As a general rule, these strap openings are properly aligned transversely although the spacing thereof may vary; therefore, adjustments of the pins relative to one another from side-to-side is much more significant than being able to adjust them vertically.

While on the subject of pins 42, it will be well to look briefly at FIG. 7 where it can be seen that even with the slide 30 raised into its uppermost position shown in FIG. 6, the lower edge 66 of element 30B thereof still partially covers recess 60 and part of the pin head 54 seated therein. Obviously, with the slide closed and latched as shown in FIG. 3, the pocket 62 is completely covered by web 48 of slide element 30B.

Finally with reference to FIGS. 1-6, inclusive, the manner of using the buckle will be set forth in detail. As previously noted, looped leather strap 12 has overlapped end portions 14 and 16. End 14 carries the series of pairs of transversely-spaced pin-receiving openings 60 that are most clearly revealed in FIG. 1. End 16, on the other hand, usually has only a single pair of openings 64 as does the fender tongue 20 when one is used. As best seen in FIG. 4, these single sets of paired openings 64 in tongue 20 and end 16 are first passed onto pins 42 while the slide is raised up into its open position of FIG. 6 to expose the latter. Then, multi-apertured end 14 is brought down through the slide (broken lines in FIG. 6) and attached to the pins so as to adjust the size of the loop and thereby set the stirrup at the proper height for the particular rider. Actually, strap end 14 lies on the inside of the loop facing away from the horse so as to remain accessible for adjustment. Once adjusted, the slide is merely telescoped down over the keeper thus covering the pins and keeping the three layers of belting securely fastened thereon. Once the slide reaches its fully-telescoped position shown in FIGS. 1, 2 and 4, the detents 36 and 38 (FIG. 5) interengage and releasably latch same in closed position. It should be mentioned that the unit will work just the same way with only two overlapped ends 14 and 16 thus eliminating the fender tongue 20, the only difference being the assembly must be thinner by the thickness of one layer of leather. Also, it can be made to accommodate any width strap.

What is claimed is:

1. A buckle for use in detachably connecting the apertured ends of a strap together in overlapped relation which comprises:

at least one pin having a shank terminating at one end in an oversize head;

a slide having front and rear walls connected together in fixed spaced relation by end walls cooperating therewith to define a sleeve having a passage therethrough sized to receive the overlapped strap ends;

a generally channel-shaped keeper having a web bordered on both sides by inturned flanges, said keeper being sized and shaped to telescope inside the slide with its web in face-to-face relation with one of the walls of the slide and its flanges in sliding engagement with the end walls thereof, said keeper web having an opening therein sized to pass the shank of the pin and hold same in position to enter registering openings in the overlapped strap ends so as to prevent relative lengthwise movement therebetween, and said web and said one slide wall cooperating with one another and with said pin to retain the head of the latter therebetween; and, means operatively interconnecting the keeper and slide effective to limit the relative telescopic movement therebetween between a closed position wherein said slide covers the shank of the pin thereby preventing removal of either of the overlapped strap ends therefrom and an open position uncovering the latter, and said means also being effective in all relative positions of said slide and keeper to prevent removal of said pin from its retained position therebetween.

2. The buckle as set forth in claim 1 wherein said means interconnecting the keeper and slide for limited telescopic movement comprises a pin and slot slidable connection between said keeper web and said one slide wall in face-to-face relation thereto.

3. The buckle as set forth in claim 1 in which:

the web of the keeper has a recess bordering the opening therein sized to receive the head of the pin and maintain same essentially flush with the adjacent surfaces of the web.

4. The buckle as set forth in claim 3 wherein the said one wall of the slide is effective in all relative telescopic positions to cover enough of the head of the pin to maintain the latter seated in its recess.

5. The buckle as set forth in claim 4 wherein the pin-receiving opening and recess are so dimensioned relative to the pin shank and head as to permit the latter to tilt relative to the web.

* * * * *